US010654271B2

(12) United States Patent
Yamamura et al.

(10) Patent No.: US 10,654,271 B2
(45) Date of Patent: May 19, 2020

(54) HEAD CHIP, LIQUID JET HEAD AND LIQUID JET RECORDING DEVICE

(71) Applicant: SII Printek Inc., Chiba-shi, Chiba (JP)

(72) Inventors: Yuki Yamamura, Chiba (JP); Daichi Nishikawa, Chiba (JP); Tomoki Kameyama, Chiba (JP); Misaki Kobayashi, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/185,857

(22) Filed: Nov. 9, 2018

(65) Prior Publication Data

US 2019/0143680 A1 May 16, 2019

(30) Foreign Application Priority Data

Nov. 13, 2017 (JP) ..... 2017-218099

(51) Int. Cl.
*B41J 2/14* (2006.01)

(52) U.S. Cl.
CPC ..... *B41J 2/1433* (2013.01); *B41J 2/14209* (2013.01); *B41J 2002/14419* (2013.01); *B41J 2002/14467* (2013.01); *B41J 2202/07* (2013.01); *B41J 2202/11* (2013.01); *B41J 2202/12* (2013.01)

(58) Field of Classification Search
CPC .. B41J 2/1433; B41J 2/14209; B41J 2/14072; B41J 2/14201
USPC ..... 347/20, 45, 47, 68
See application file for complete search history.

(56) References Cited

U.S. PATENT DOCUMENTS

| | | | | |
|---|---|---|---|---|
| 5,252,994 | A | 10/1993 | Narita et al. | |
| 6,014,153 | A | 1/2000 | Harvey | |
| 8,585,182 | B2 | 11/2013 | Koseki | |
| 9,221,260 | B2 * | 12/2015 | Domae | B41J 2/14209 |
| 9,610,769 | B2 * | 4/2017 | Kubota | B41J 2/1631 |
| 9,802,406 | B2 * | 10/2017 | Nishikawa | B41J 2/14209 |
| 2011/0074845 | A1 | 3/2011 | Kitakami et al. | |

(Continued)

FOREIGN PATENT DOCUMENTS

| | | | |
|---|---|---|---|
| EP | 2540503 | A1 | 1/2013 |
| JP | 2012-51253 | A | 3/2012 |
| JP | 2017-052214 | A | 3/2017 |

OTHER PUBLICATIONS

Extended European Search Report in Europe Application No. 18206040.0, dated Apr. 5, 2019, 10 pages.

*Primary Examiner* — An H Do
(74) *Attorney, Agent, or Firm* — Brinks Gilson & Lione

(57) ABSTRACT

There are provided a head chip, a liquid jet head, and a liquid jet recording device capable of improving the ejection stability. The head chip according to an embodiment of the disclosure includes an actuator plate having a plurality of ejection grooves each filled with liquid, a nozzle plate having a plurality of nozzle holes individually communicated with the plurality of ejection grooves, and a cover plate having a through hole through which the liquid flows into and/or from the ejection groove, and a wall part adapted to cover the ejection groove. A flow channel of the liquid in a part adapted to communicate the through hole and the ejection groove with each other includes a principal flow channel section, and an expanded flow channel section provided to the wall part, and adapted to increase a cross-sectional area of the flow channel.

9 Claims, 13 Drawing Sheets

(56) References Cited

U.S. PATENT DOCUMENTS

| | | | |
|---|---|---|---|
| 2012/0050413 | A1 | 3/2012 | Miyazawa |
| 2013/0271531 | A1 | 10/2013 | Koseki |
| 2016/0318302 | A1 | 11/2016 | Kubota |

* cited by examiner

HEAD CHIP, LIQUID JET HEAD AND LIQUID JET RECORDING DEVICE

RELATED APPLICATIONS

This application claims priority under 35 U.S.C. § 119 to Japanese Patent Application No. 2017-218099 filed on Nov. 13, 2017, the entire content of which is hereby incorporated by reference.

BACKGROUND OF THE INVENTION

1. Field of the Invention

The present disclosure relates to a head chip, a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., JP-A-2012-51253).

In the liquid jet recording device of this type, it is arranged that the ink is supplied from an ink tank to an inkjet head (a liquid jet head), and then the ink is ejected from nozzle holes of the inkjet head toward the recording target medium to thereby perform recording of the images, the characters, and so on. Further, such an inkjet head is provided with a head chip for ejecting the ink.

In such a head chip or the like, in general, it is required to improve ejection stability. It is desirable to provide a head chip, a liquid jet head, and a liquid jet recording device capable of improving the ejection stability.

SUMMARY OF THE INVENTION

The head chip according to an embodiment of the disclosure includes an actuator plate having a plurality of ejection grooves each filled with the liquid, a nozzle plate having a plurality of nozzle holes individually communicated with the plurality of ejection grooves, and a cover plate having a through hole through which the liquid flows into and/or from the ejection groove, and a wall part adapted to cover the ejection groove. A flow channel of the liquid in a part adapted to communicate the through hole and the ejection groove with each other includes a principal flow channel section, and an expanded flow channel section provided to the wall part, and adapted to increase a cross-sectional area of the flow channel.

A liquid jet head according to an embodiment of the disclosure is equipped with the head chip according to an embodiment of the disclosure.

A liquid jet recording device according to an embodiment of the disclosure is equipped with the liquid jet head according to an embodiment of the disclosure, and a containing section adapted to contain the liquid.

According to the head chip, the liquid jet head and the liquid jet recording device related to an embodiment of the disclosure, it becomes possible to improve the ejection stability.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (First One of Examples Having Groove Sections as Expanded Flow Channel Sections; an Example Having the Expanded Flow Channel Sections Disposed on an Inflow Side and an Outflow Side)
2. Modified Examples Modified Example 1 (second one of the examples having groove sections as expanded flow channel sections; an example of the case in which side surfaces of the groove sections are shaped like a curved surface).

Modified Example 2 (third one of the examples having groove sections as expanded flow channel sections; an example having the expanded flow channel sections disposed only on an inflow side).

Modified Example 3 (fourth one of the examples having groove sections as expanded flow channel sections; an example having the expanded flow channel sections disposed only on an outflow side).

Modified Example 4 (first one of examples having bypass flow channels as expanded flow channel sections; an example having the expanded flow channel sections disposed on an inflow side and an outflow side).

Modified Example 5 (second one of the examples having bypass flow channels as expanded flow channel sections; an example having the expanded flow channel sections disposed only on an inflow side).

Modified Example 6 (third one of the examples having bypass flow channels as expanded flow channel sections; an example having the expanded flow channel sections disposed only on an outflow side).

Modified Example 7 (fifth one of the examples having groove sections as expanded flow channel sections; an example with an edge-shoot type).

Modified Example 8 (fourth one of the examples having bypass flow channels as expanded flow channel sections; an example with an edge-shoot type).

3. Other Modified Examples

1. Embodiment

[Overall Configuration of Printer 1]

Figure 1:
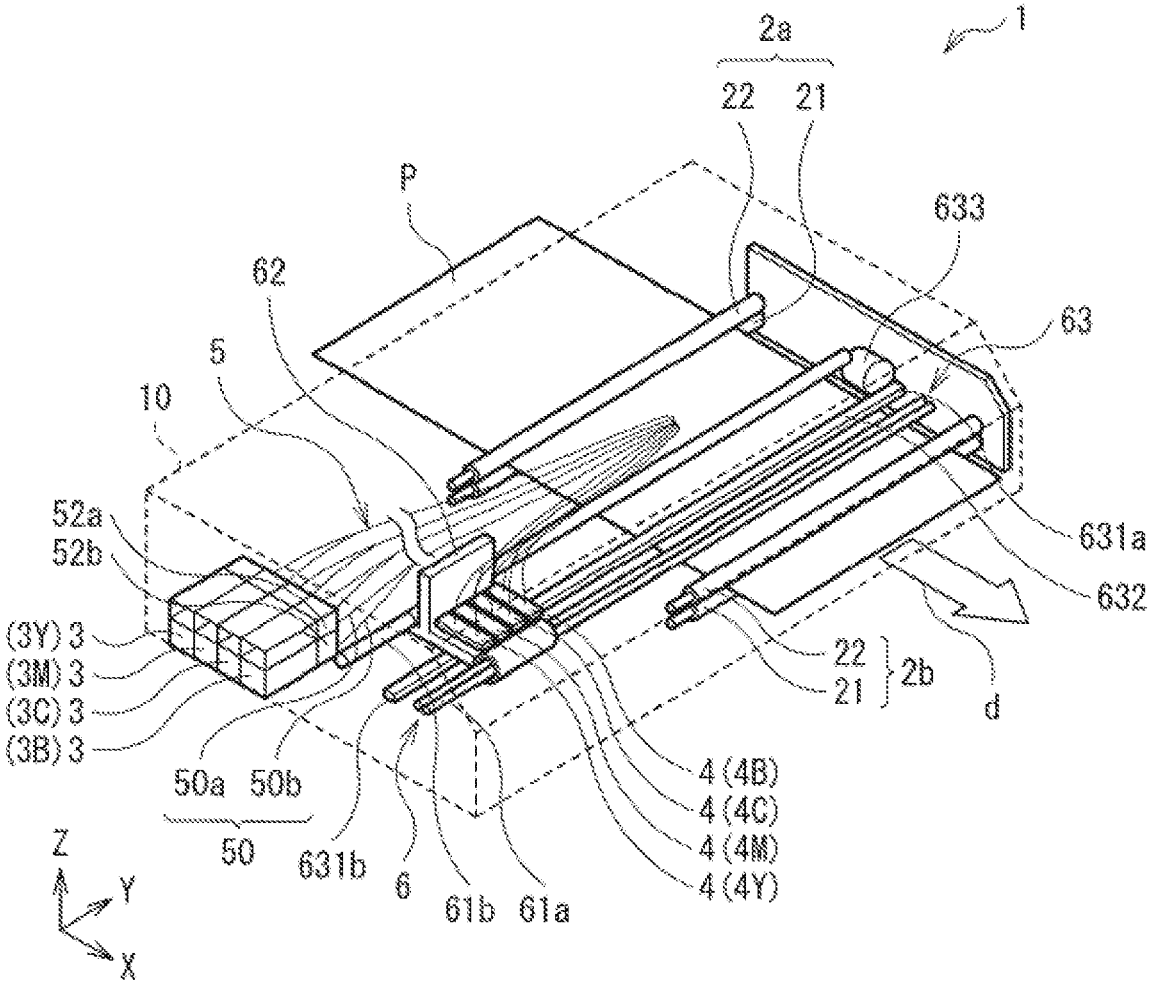
FIG. 1 is a schematic perspective view showing a schematic configuration example of a liquid jet recording device according to one embodiment of the disclosure.

FIG. 1 is a perspective view schematically showing a schematic configuration example of a printer 1 as a liquid jet recording device according to one embodiment of the present disclosure. The printer 1 is an inkjet printer for performing recording (printing) of images, characters, and so on, on recording paper P as a recording target medium using ink 9 described later.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each member is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4B described later) each correspond to a specific example of a "liquid jet head" in the present disclosure. Further, the ink 9 corresponds to a specific example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink 9 contained, and are therefore collectively referred to as ink tanks 3 in the following description. Further, the ink tanks 3 (3Y, 3M, 3C, and 3B) correspond to an example of a "containing section" in the present disclosure.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording of images, characters, and so on. As the inkjet heads 4, there are also disposed 4 types of heads for individually jetting the 4 colors of ink 9 respectively contained by the ink tanks 3Y, 3M, 3C, and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction inside the housing 10.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later (FIG. 2 through FIG. 5).

(Circulation Mechanism 5)

The circulation mechanism 5 is a mechanism for circulating the ink 9 between the inside of the ink tanks 3 and the inside of the inkjet heads 4. The circulation mechanism 5 is configured including, for example, circulation channels 50 as flow channels for circulating the ink 9, and pairs of liquid feeding pumps 52*a*, 52*b*.

As shown in FIG. 1, the circulation channels 50 each have a flow channel 50*a* as a part extending from the ink tank 3 to reach the inkjet head 4 via the liquid feeding pump 52*a*, and a flow channel 50*b* as a part extending from the inkjet head 4 to reach the ink tank 3 via the liquid feeding pump 52*b*. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3. It should be noted that these flow channels 50*a*, 50*b* (supply tubes of the ink 9) are each formed of a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the X-axis direction. To the endless belt 632, there is connected the carriage 62. On the carriage 62, there are disposed the four types of inkjet heads 4Y, 4M, 4C, and 4B arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Then, the detailed configuration example of the inkjet heads 4 (head chips 41) will be described with reference to FIG. 2 through FIG. 5, in addition to FIG. 1.

Figure 2:
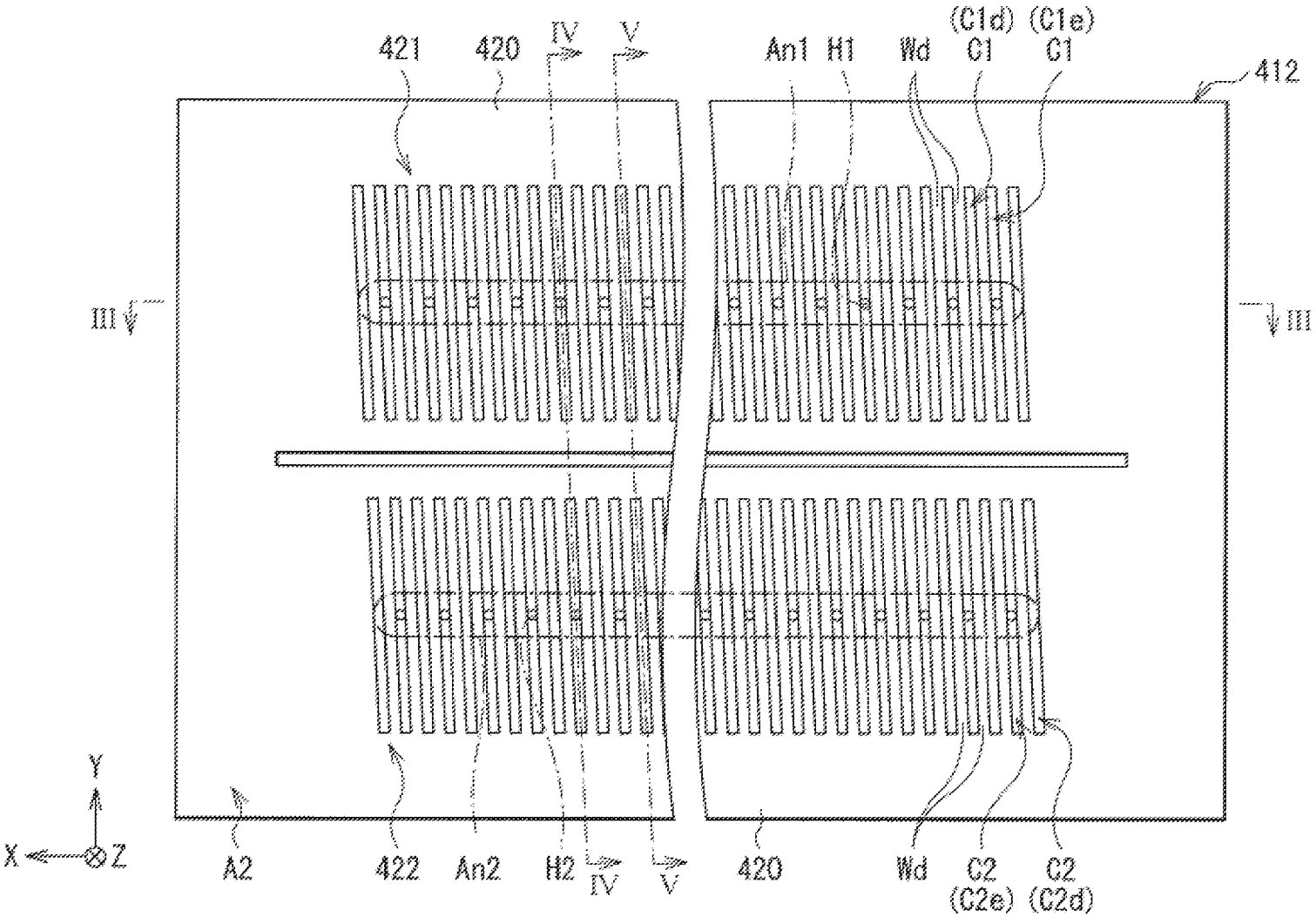
FIG. 2 is a perspective bottom view showing a configuration example of a substantial part of the liquid jet head shown in FIG. 1.
Figure 3:
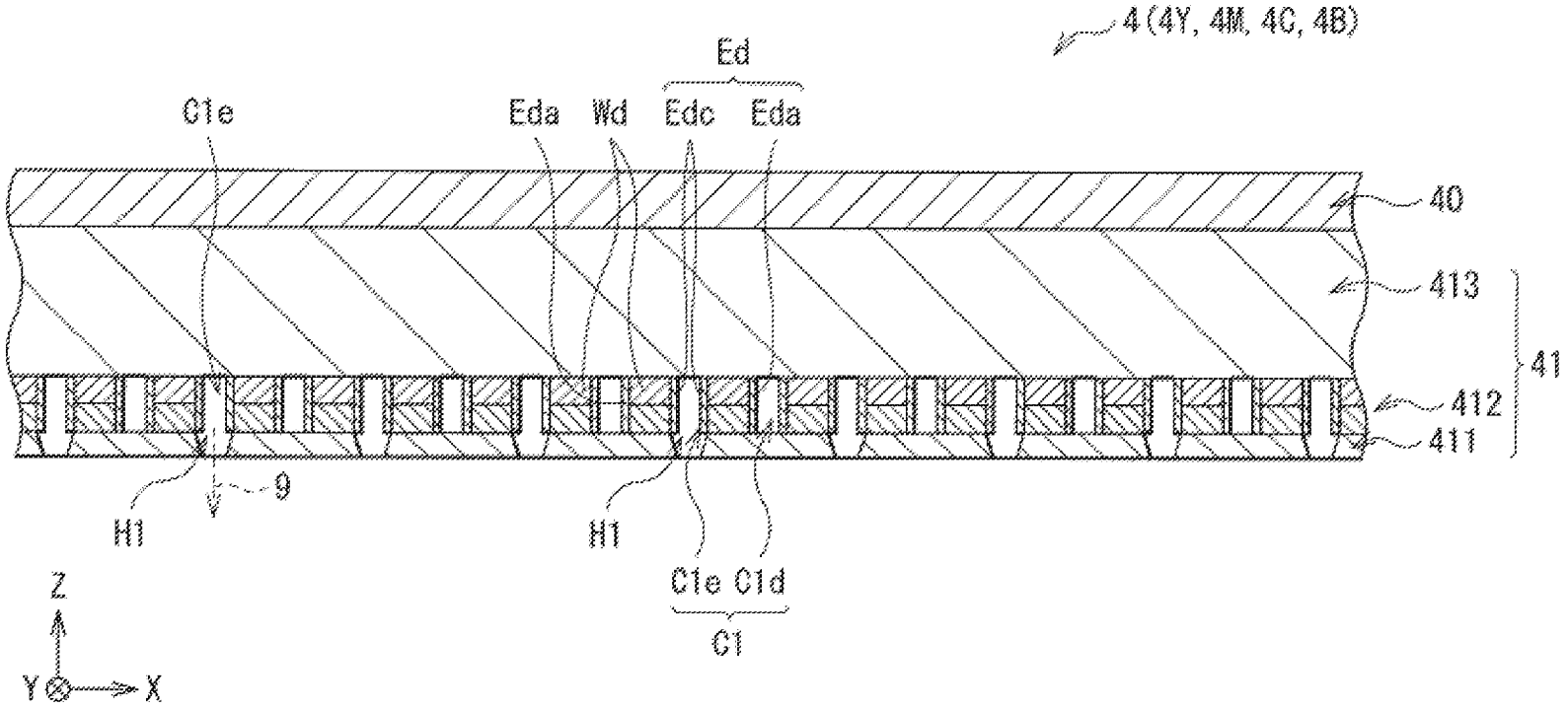
FIG. 3 is a schematic diagram showing a cross-sectional configuration example along the line in the head chip shown in FIG. 2.
Figure 4:
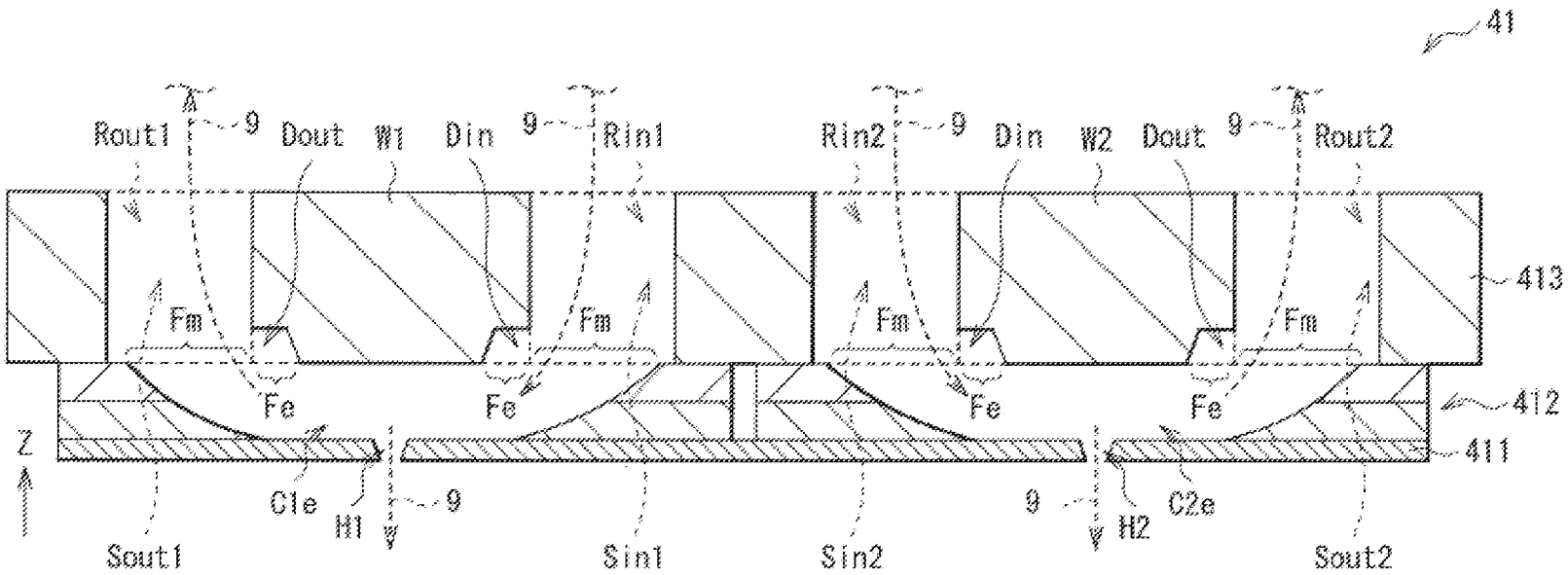
FIG. 4 is a schematic diagram showing a cross-sectional configuration example of the head chip along the line IV-IV shown in FIG. 2.
Figure 5:
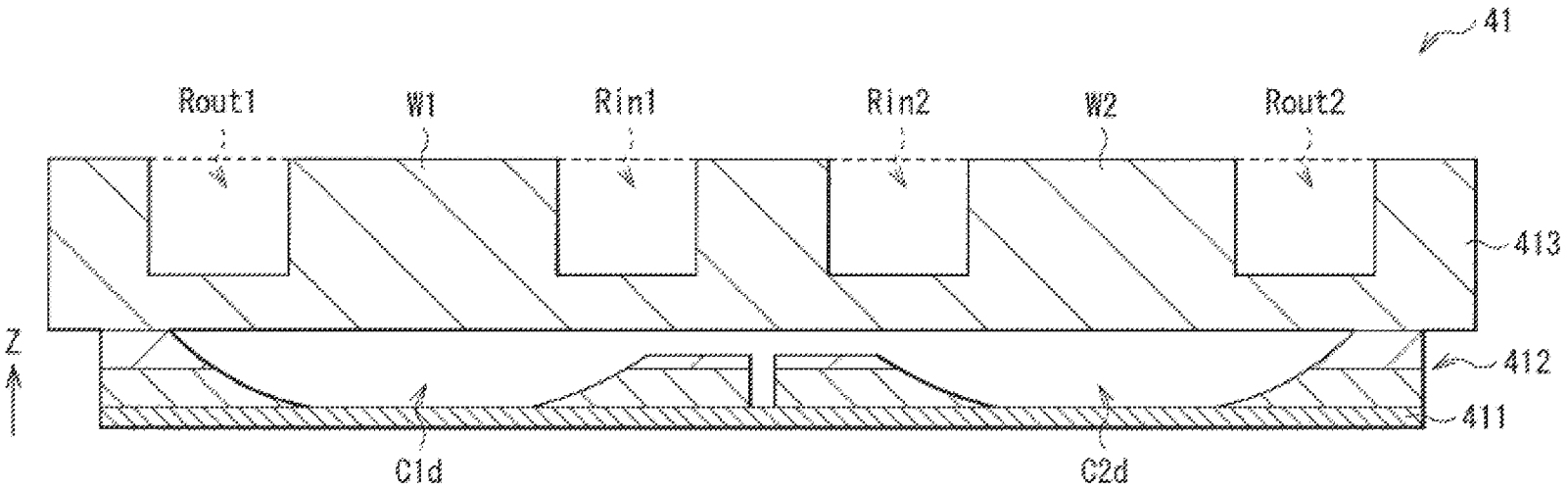
FIG. 5 is a schematic diagram showing a cross-sectional configuration example of the head chip along the line V-V shown in FIG. 2.

FIG. 2 is a diagram schematically showing a bottom view (an X-Y bottom view) of a configuration example of a substantial part of the inkjet head 4 in the state in which a nozzle plate 411 (described later) is removed. FIG. 3 is a diagram schematically showing a cross-sectional configuration example (a Z-X cross-sectional configuration example) of the inkjet head 4 along the line shown in FIG. 2. Similarly, FIG. 4 is a diagram schematically showing a cross-sectional configuration example of the inkjet head 4 along the line IV-IV shown in FIG. 2, and corresponds to a cross-sectional configuration example of a vicinity of ejection channels C1*e*, C2*e* (ejection grooves) in the head chip 41 described later. Further, FIG. 5 is a diagram schematically showing a cross-sectional configuration example of the inkjet head 4 along the line V-V shown in FIG. 2, and corresponds to a cross-sectional configuration example of a vicinity of dummy channels C1*d*, C2*d* (non-ejection grooves) in the head chip 41 described later.

The inkjet heads 4 according to the present embodiment are each an inkjet head of a so-called side-shoot type for ejecting the ink 9 from a central part in an extending direction (an oblique direction described later) of a plurality of channels (a plurality of channels C1 and a plurality of channels C2) in the head chip 41 described later. Further, the inkjet heads 4 are each an inkjet head of a circulation type which uses the circulation mechanism 5 (the circulation channel 50) described above to thereby use the ink 9 while circulated between the inkjet head 4 and the ink tank 3.

As shown in FIG. 3, the inkjet heads 4 are each provided with the head chip 41 and a flow channel plate 40. Further, the inkjet heads 4 are each provided with a circuit board and flexible printed circuit board (FPC) as a control mechanism (a mechanism for controlling the operation of the head chip 41) not shown.

The circuit board is a board for mounting a drive circuit (an electric circuit) for driving the head chip 41. The flexible printed circuit board is a board for electrically connecting the drive circuit on the circuit board and drive electrodes Ed described later in the head chip 41 to each other. It should be noted that it is arranged that such flexible printed circuit board is provided with a plurality of extraction electrodes described later as printed wiring.

As shown in FIG. 3, the head chip 41 is a member for jetting the ink 9 along the Z-axis direction, and is configured using a variety of types of plates. Specifically, as shown in FIG. 3, the head chip 41 is mainly provided with a nozzle plate (a jet hole plate) 411, an actuator plate 412 and a cover plate 413. The nozzle plate 411, the actuator plate 412, the cover plate 413, and the flow channel plate 40 described above are bonded to each other using, for example, an adhesive, and are stacked on one another in this order along the Z-axis direction. It should be noted that the description will hereinafter be presented with the flow channel plate 40 side (the cover plate 413 side) along the Z-axis direction referred to as an upper side, and the nozzle plate 411 side referred to as a lower side.

(Nozzle Plate 411)

The nozzle plate 411 is formed of a film member made of polyimide or the like having a thickness of, for example, about 50 μm, and is bonded to a lower surface of the actuator plate 412 as shown in FIG. 3. It should be noted that the constituent material of the nozzle plate 411 is not limited to the resin material such as polyimide, but can also be, for example, a metal material. Further, as shown in FIG. 2, the nozzle plate 411 is provided with two nozzle columns (nozzle columns An1, An2) each extending along the X-axis direction. These nozzle columns An1, An2 are arranged along the Y-axis direction with a predetermined distance. As described above, the inkjet head 4 (the head chip 41) of the present embodiment is formed as a two-column type inkjet head (head chip).

The nozzle column An1 has a plurality of nozzle holes H1 formed so as to be arranged in a straight line at predetermined intervals along the X-axis direction. These nozzle holes H1 each penetrate the nozzle plate 411 along the thickness direction of the nozzle plate 411 (the Z-axis direction), and are communicated with the respective ejection channels C1*e* in the actuator plate 412 described later as shown in, for example, FIG. 3 and FIG. 4. Specifically, as shown in FIG. 2, each of the nozzle holes H1 is formed so as to be located in a central part along the extending direction (an oblique direction described later) of the ejection channels C1*e*. Further, the formation pitch along the X-axis direction in the nozzle holes H1 is arranged to be equal (to have an equal pitch) to the formation pitch along the X-axis direction in the ejection channels C1*e*. Although the details will be described later, it is arranged that the ink 9 supplied from the inside of the ejection channel C1*e* is ejected (jetted) from each of the nozzle holes H1 in such a nozzle column An1.

The nozzle column An2 similarly has a plurality of nozzle holes H2 formed so as to be arranged in a straight line at predetermined intervals along the X-axis direction. These nozzle holes H2 each penetrate the nozzle plate 411 along the thickness direction of the nozzle plate 411, and are communicated with the respective ejection channels C2*e* in the actuator plate 412 described later. Specifically, as shown in FIG. 2, each of the nozzle holes H2 is formed so as to be located in a central part along the extending direction (an oblique direction described later) of the ejection channels C2*e*. Further, the formation pitch along the X-axis direction in the nozzle holes H2 is arranged to be equal to the formation pitch along the X-axis direction in the ejection channels C2*e*. Although the details will be described later, it is arranged that the ink 9 supplied from the inside of the ejection channel C2*e* is also ejected from each of the nozzle holes H2 in such a nozzle column An2.

Further, as shown in FIG. 2, the nozzle holes H1 in the nozzle column An1 and the nozzle holes H2 in the nozzle column An2 are arranged in a staggered manner along the X-axis direction. Therefore, in each of the inkjet heads 4 according to the present embodiment, the nozzle holes H1 in the nozzle column An1 and the nozzle holes H2 in the nozzle column An2 are arranged in a zigzag manner. It should be noted that such nozzle holes H1, H2 each have a tapered through hole gradually decreasing in diameter toward the lower side.

(Actuator Plate 412)

The actuator plate 412 is a plate formed of a piezoelectric material such as lead zirconate titanate (PZT). As shown in FIG. 3, the actuator plate 412 is formed by stacking two piezoelectric substrates different in polarization direction from each other on one another along the thickness direction (the Z-axis direction) (a so-called chevron type). It should be noted that the configuration of the actuator plate 412 is not limited to the chevron type. Specifically, it is also possible to form the actuator plate 412 with, for example, a single (unique) piezoelectric substrate having the polarization direction set one direction along the thickness direction (the Z-axis direction) (a so-called cantilever type).

Further, as shown in FIG. 2, the actuator plate 412 is provided with two channel columns (channel columns 421, 422) each extending along the X-axis direction. These channel columns 421, 422 are arranged along the Y-axis direction with a predetermined distance.

In such an actuator plate 412, as shown in FIG. 2, an ejection area (jetting area) of the ink 9 is disposed in a central part (the formation areas of the channel columns 421, 422) along the X-axis direction. On the other hand, in the actuator plate 412, a non-ejection area (non-jetting area) of the ink 9 is disposed in each of the both end parts (non-formation areas of the channel columns 421, 422) along the X-axis direction. The non-ejection areas are located on the outer side along the X-axis direction with respect to the ejection area described above. It should be noted that the both end parts along the Y-axis direction in the actuator plate 412 each constitute a tail part 420 as shown in FIG. 2.

As shown in FIG. 2 and FIG. 3, the channel column 421 described above has a plurality of channels C1. As shown in FIG. 2, these channels C1 extend along an oblique direction forming a predetermined angle (an acute angle) with the Y-axis direction inside the actuator plate 412. Further, as shown in FIG. 2, these channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view (see FIG. 3).

As shown in FIG. 2, the channel column 422 similarly has a plurality of channels C2 extending along the oblique direction described above. As shown in FIG. 2, these channels C2 are arranged side by side so as to be parallel to each other at predetermined intervals along the X-axis direction. Each of the channels C2 is also partitioned with drive walls Wd described above, and forms a groove section having a recessed shape in a cross-sectional view.

Here, as shown in FIG. 2 through FIG. 5, in the channels C1, there exist ejection channels C1*e* (ejection grooves) for ejecting the ink 9, and dummy channels C1*d* (non-ejection grooves) not ejecting the ink 9. As shown in FIG. 2 and FIG. 3, in the channel column 421, the ejection channels C1*e* and the dummy channels C1*d* are alternately arranged along the X-axis direction. Each of the ejection channels C1*e* is communicated with the nozzle hole H1 in the nozzle plate 411 on the one hand, but each of the dummy channels C1*d* is not communicated with the nozzle hole H1, and is covered with the upper surface of the cover plate 411 from below on the other hand (see FIG. 3 through FIG. 5).

Similarly, as shown in FIG. 2, FIG. 4 and FIG. 5, in the channels C2, there exist ejection channels C2*e* (ejection grooves) for ejecting the ink 9, and dummy channels C2*d* (non-ejection grooves) not ejecting the ink 9. As shown in FIG. 2, in the channel column 422, the ejection channels C2*e* and the dummy channels C2*d* are alternately arranged along the X-axis direction. Each of the ejection channels C2*e* is communicated with the nozzle hole H2 in the nozzle plate 411 on the one hand, but each of the dummy channels C2*d* is not communicated with the nozzle hole H2, and is covered with the upper surface of the cover plate 411 from below on the other hand (see FIG. 4 and FIG. 5).

It should be noted that such ejection channels C1*e*, C2*e* each correspond to a specific example of the "ejection groove" in the present disclosure.

Further, as indicated by the line IV-IV in FIG. 2, the ejection channels C1*e* in the channel column 421 and the ejection channel C2*e* in the channel column 422 are disposed in alignment with each other (see FIG. 4) along the extending direction (the oblique direction described above) of these ejection channels C1*e*, C2*e*. Similarly, as indicated by the line V-V in FIG. 2, the dummy channels C1*d* in the channel column 421 and the dummy channel C2*d* in the channel column 422 are disposed in alignment with each other (see FIG. 5) along the extending direction (the oblique direction described above) of these dummy channels C1*d*, C2*d*.

Here, as shown in FIG. 3, the drive electrode Ed extending along the oblique direction described above is disposed on each of the inside surfaces opposed to each other in the drive walls Wd described above. As the drive electrodes Ed, there exist common electrodes Edc disposed on the inner side surfaces facing the ejection channels C1*e*, C2*e*, and individual electrodes (active electrodes) Eda disposed on the inner side surfaces facing the dummy channels C1*d*, C2*d*. It should be noted that such drive electrodes Ed (the common electrodes Edc and the active electrodes Eda) are each formed in the entire area in the depth direction (the Z-axis direction) on the inner side surface of the drive wall Wd as shown in FIG. 3.

The pair of common electrodes Edc opposed to each other in the same ejection channel C1*e* (or the same ejection channel C2*e*) are electrically connected to each other in a common terminal (a common interconnection) not shown. Further, the pair of individual electrodes Eda opposed to each other in the same dummy channel C1*d* (or the same dummy channel C2*d*) are electrically separated from each other. In contrast, the pair of individual electrodes Eda opposed to each other via the ejection channel C1*e* (or the ejection channel C2*e*) are electrically connected to each other in an individual terminal (an individual interconnection) not shown.

Here, in the tail parts 420 described above, there are mounted the flexible printed circuit board described above for electrically connecting the drive electrodes Ed and the circuit board described above to each other. Interconnection patterns (not shown) provided to the flexible printed circuit board are electrically connected to the common interconnections and the individual interconnections described above. Thus, it is arranged that a drive voltage is applied to each of the drive electrodes Ed from the drive circuit on the circuit board described above via the flexible printed circuit board.

(Cover Plate 413)

As shown in FIG. 2 through FIG. 5, the cover plate 413 is disposed so as to close the channels C1, C2 (the channel columns 421, 422) in the actuator plate 412. Specifically, the cover plate 413 is bonded to the upper surface of the actuator plate 412, and has a plate-like structure.

As shown in FIG. 5, the cover plate 413 is provided with a pair of entrance side common ink chambers Rin1, Rin2 and a pair of exit side common ink chambers Rout1, Rout2. The entrance side common ink chambers Rin1, Rin2 and the exit side common ink chambers Rout1, Rout2 each extend along the X-axis direction, and are arranged side by side so as to be parallel to each other at predetermined intervals. Further, the entrance side common ink chamber Rin1 and the exit side common ink chamber Rout1 are each formed in an area corresponding to the channel column 421 (the plurality of channels C1) in the actuator plate 412. Meanwhile, the entrance side common ink chamber Rin2 and the exit side common ink chamber Rout2 are each formed in an area corresponding to the channel column 422 (the plurality of channels C2) in the actuator plate 412.

The entrance side common ink chamber Rin1 is formed in the vicinity of an inner end part along the Y-axis direction in the channels C1, and forms a groove section having a recessed shape (see FIG. 5). In areas corresponding respectively to the ejection channels C1*e* in the entrance side common ink chamber Rin1, there are respectively formed supply slits Sin1 penetrating the cover plate 413 along the thickness direction (the Z-axis direction) of the cover plate 413 (see FIG. 4). Similarly, the entrance side common ink chamber Rin2 is formed in the vicinity of an inner end part along the Y-axis direction in the channels C2, and forms a groove section having a recessed shape (see FIG. 5). In areas corresponding respectively to the ejection channels C2*e* in the entrance side common ink chamber Rin2, there are respectively formed supply slits Sin2 penetrating the cover plate 413 along the thickness direction of the cover plate 413 (see FIG. 4).

It should be noted that these supply slits Sin1, Sin2 each correspond to a specific example of a "through hole" and a "first through hole" in the present disclosure.

The exit side common ink chamber Rout1 is formed in the vicinity of an outer end part along the Y-axis direction in the channels C1, and forms a groove section having a recessed shape (see FIG. 5). In areas corresponding respectively to the ejection channels C1*e* in the exit side common ink chamber Rout1, there are respectively formed discharge slits Sout1 penetrating the cover plate 413 along the thickness direction of the cover plate 413 (see FIG. 4). Similarly, the exit side common ink chamber Rout2 is formed in the vicinity of an outer end part along the Y-axis direction in the channels C2, and forms a groove section having a recessed shape (see FIG. 5). In areas corresponding respectively to the ejection channels C2*e* in the exit side common ink chamber Rout2, there are also respectively formed discharge slits Sout2 penetrating the cover plate 413 along the thickness direction of the cover plate 413 (see FIG. 4).

It should be noted that these discharge slits Sout1, Sout2 each correspond to a specific example of a "through hole" and a "second through hole" in the present disclosure.

In such a manner, the entrance side common ink chamber Rin1 and the exit side common ink chamber Rout1 are communicated with each of the ejection channels C1*e* via the supply slit Sin1 and the discharge slit Sout1 on the one hand, but are not communicated with each of the dummy channels C1*d* on the other hand (see FIG. 4 and FIG. 5). In other words, it is arranged that each of the dummy channels C1*d* is closed by a bottom part of the entrance side common ink chamber Rin1 and a bottom part of the exit side common ink chamber Rout1 (see FIG. 5).

Similarly, the entrance side common ink chamber Rin2 and the exit side common ink chamber Rout2 are communicated with each of the ejection channels C2*e* via the supply slit Sin2 and the discharge slit Sout2 on the one hand, but are not communicated with each of the dummy channels C2*d* on the other hand (see FIG. 4 and FIG. 5). In other words, it is arranged that each of the dummy channels C2*d* is closed by a bottom part of the entrance side common ink chamber Rin2 and a bottom part of the exit side common ink chamber Rout2 (see FIG. 5).

(Flow Channel Plate 40)

As shown in FIG. 3, the flow channel plate 40 is disposed on the upper surface of the cover plate 413, and has a predetermined flow channel (not shown) through which the ink 9 flows. Further, to the flow channel in such a flow channel plate 40, there are connected the flow channels 50*a*, 50*b* in the circulation mechanism 5 described above so as to achieve inflow of the ink 9 to the flow channel and outflow of the ink 9 from the flow channel, respectively.

[Flow Channel Structure Around Ejection Channels C1*e*, C2*e*]

Then, the flow channel structure of the ink 9 in a part for communicating the supply slit Sin1, Sin2 and the discharge slit Sout1, Sout2 described above with the ejection channel C1*e*, C2*e* will be described in detail with reference to FIG. 4 (a cross-sectional configuration example of the vicinity of the ejection channels C1*e*, C2*e*) described above.

As shown in FIG. 4, in the head chip 41 according to the present embodiment, the cover plate 413 is provided with the supply slits Sin1, Sin2, the discharge slits Sout1, Sout2, and wall parts W1, W2. Specifically, the supply slits Sin1 and the discharge slits Sout1 are each a through hole through which the ink 9 flows to or from the ejection channel C1*e*, and the supply slits Sin2 and the discharge slits Sout2 are each a through hole through which the ink 9 flows to or from the ejection channel C2*e*. In detail, as indicated by the dotted arrows in FIG. 4, the supply slits Sin1, Sin2 are through holes for making the ink 9 inflow into the ejection channels C1*e*, C2*e*, respectively, and the discharge slits Sout1, Sout2 are through holes for making the ink 9 outflow from the inside of the ejection channels C1*e*, C2*e*, respectively. Further, the wall part W1 described above is disposed so as to cover above the ejection channel C1*e*, and the wall part W2 described above is disposed so as to cover above the ejection channel C2*e*. As shown in FIG. 4, these ejection channels C1*e*, C2*e* each have arc-like side surfaces with which the cross-sectional area of each of the ejection channels C1*e*, C2*e* gradually decreases in a direction from the cover plate 413 side (upper side) toward the nozzle plate 411 side (lower side). It should be noted that it is arranged that the arc-like side surfaces of such ejection channels C1*e*, C2*e* are each formed by, for example, cutting work using a dicer.

Here, in the head chip 41 according to the present embodiment, the flow channel structure of the ink 9 in the part (a communication part) for communicating such a supply slit Sin1, Sin2 and the discharge slit Sout1, Sout2 with the ejection channel C1*e*, C2*e* is arranged as follows. That is, as shown in FIG. 4, the flow channel of the ink 9 in this communication part has a principal flow channel section Fm as a main flow channel part, and an expanded flow channel section Fe as a part which is provided to the wall parts W1, W2 and increases the cross-sectional area of the flow channel of the communication part. Specifically, in the present embodiment, as shown in FIG. 4, the expanded flow channel section Fe corresponds to each of groove sections Din, Dout respectively provided to edge parts on the nozzle hole H1, H2 side of the inner side surfaces in the supply slit Sin1, Sin2 and the discharge slit Sout1, Sout2 and the ejection channel C1*e*, C2*e*. More specifically, the groove section Din is provided to an edge part on the nozzle hole H1 side of the inner side surfaces in the supply slit Sin1, and the groove section Din is provided to an edge part on the nozzle hole H2 side of the inner side surfaces in the supply slit Sin2. Further, the groove section Dout is provided to an edge part on the nozzle hole H1 side of the inner side surfaces in the discharge slit Sout1, and the groove section Dout is provided to an edge part on the nozzle hole H2 side of the inner side surfaces in the discharge slit Sout2.

It should be noted that these groove sections Din, Dout are each arranged to be formed (formed by chamfering) by chamfering the edge part (corner part) on the nozzle hole H1, H2 side of the inner side surfaces described above. Further, as shown in FIG. 4, in the present embodiment, the side surface of each of the groove sections Din, Dout has an inverse tapered shape so that the cross-sectional area of the groove section Din, Dout gradually increases in a direction toward the ejection channel C1*e*, C2*e* (in a downward direction).

Here, in the head chip 41 according to the present embodiment, the expanded flow channel section Fe described above is provided to the flow channel at, at least, the part for communicating the supply slit Sin1, Sin2 with the ejection channel C1*e*, C2*e* in the supply slit Sin1, Sin2 and the discharge slit Sout1, Sout2. Specifically, in the present embodiment, as shown in FIG. 4, the expanded flow channel section Fe is provided to both of the flow channel in the part for communicating the supply slit Sin1, Sin2 with the ejection channel C1*e*, C2*e*, and the flow channel in the part for communicating the discharge slit Sout1, Sout2 with the ejection channel C1*e*, C2*e*. In other words, in the present embodiment, it is arranged that both of the groove sections Din, Dout described above are provided.

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* rotate to thereby carry the recording paper P along the carrying direction d (the X-axis direction) between the grit rollers 21 and the pinch rollers 22. Further, at the same time as such a carrying operation, the drive motor 633 in the drive mechanism 63 respectively rotates the pulleys 631*a*, 631 *b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

(B. Detailed Operation in Inkjet Heads 4)

Then, the detailed operation (the jet operation of the ink 9) in the inkjet heads 4 will be described with reference to FIG. 1 through FIG. 5. Specifically, in the inkjet heads 4 (the side-shoot type) according to the present embodiment, the jet operation of the ink 9 using a shear mode is performed in the following manner.

Firstly, when the reciprocation of the carriage 62 (see FIG. 1) described above is started, the drive circuit on the circuit board described above applies the drive voltage to the drive electrodes Ed (the common electrodes Edc and the individual electrodes Eda) in the inkjet head 4 via the flexible printed circuit boards described above. Specifically, the drive circuit applies the drive voltage to the drive electrodes Ed disposed on the pair of drive walls Wd forming the ejection channel C1*e*, C2*e*. Thus, the pair of drive walls Wd each deform (see FIG. 3) so as to protrude toward the dummy channel C1*d*, C2*d* adjacent to the ejection channel C1*e*, C2*e*.

Here, as described above, in the actuator plate 412, the polarization direction differs along the thickness direction (the two piezoelectric substrates described above are stacked on one another), and at the same time, the drive electrodes Ed are formed in the entire area in the depth direction on the inner side surface in each of the drive walls Wd. Therefore, by applying the drive voltage using the drive circuit described above, it results that the drive wall Wd makes a flexion deformation to have a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges. Incidentally, in the case in which the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the capacity of the ejection channel C1*e*, C2*e* increases. Further, due to the increase of the capacity of the ejection channel C1*e*, C2*e*, it results that the ink 9 retained in the entrance side common ink chamber Rin1, Rin2 is induced into the ejection channel C1*e*, C2*e* (see FIG. 4).

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing at which the pressure wave has reached the nozzle hole H1, H2 of the nozzle plate 411. Thus, the drive walls Wd are restored from the state of the flexion deformation described above, and as a result, the capacity of the ejection channel C1*e*, C2*e* having once increased is restored again (see FIG. 3).

When the capacity of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 3 and FIG. 4) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

In particular, the nozzle holes H1, H2 of the present embodiment each have the tapered cross-sectional shape gradually decreasing in diameter toward the outlet (see FIG. 3 and FIG. 4) as described above, and can therefore eject the ink 9 straight (good in straightness) at high speed. Therefore, it becomes possible to perform recording high in image quality.

(C. Circulation Operation of Ink 9)

Then, the circulation operation of the ink 9 by the circulation mechanism 5 will be described in detail with reference to FIG. 1 and FIG. 4.

As shown in FIG. 1, in the printer 1, the ink 9 is fed by the liquid feeding pump 52*a* from the inside of the ink tank 3 to the inside of the flow channel 50*a*. Further, the ink 9 flowing through the flow channel 50*b* is fed by the liquid feeding pump 52*b* to the inside of the ink tanks 3.

On this occasion, in the inkjet head 4, the ink 9 flowing from the inside of the ink tank 3 via the flow channel 50*a* inflows into the entrance side common ink chambers Rin1, Rin2. As shown in FIG. 4, the ink 9 having been supplied to these entrance side common ink chambers Rin1, Rin2 is supplied to the ejection channels C1*e*, C2*e* in the actuator plate 412 via the supply slits Sin1, Sin2.

Further, as shown in FIG. 4, the ink 9 in the ejection channels C1*e*, C2*e* flows into the exit side common ink chambers Rout1, Rout2 via the discharge slits Sout1, Sout2, respectively. The ink 9 having been supplied to these exit side common ink chambers Rout1, Rout2 is discharged to the flow channel 50*b* to thereby outflow from the inkjet head 4. Then, the ink 9 having been discharged to the flow channel 50*b* is returned to the inside of the ink tank 3 as a result. In such a manner, the circulation operation of the ink 9 by the circulation mechanism 5 is achieved.

Here, in the inkjet head which is not the circulation type, in the case in which ink of a fast drying type is used, there is a possibility that a local increase in viscosity or local solidification of the ink occurs due to drying of the ink in the vicinity of the nozzle hole, and as a result, a failure such as a failure in ejection of the ink occurs. In contrast, in the inkjet heads 4 (the circulation type inkjet heads) according to the present embodiment, since the fresh ink 9 is always supplied to the vicinity of the nozzle holes H1, H2, the failure such as the failure in ejection of the ink described above is prevented as a result.

(D. Functions/Advantages)

Then, the functions and the advantages in the head chip 41, the inkjet head 4 and the printer 1 according to the present embodiment will be described in detail while comparing with a comparative example.

(Comparative Example)

Figure 6:
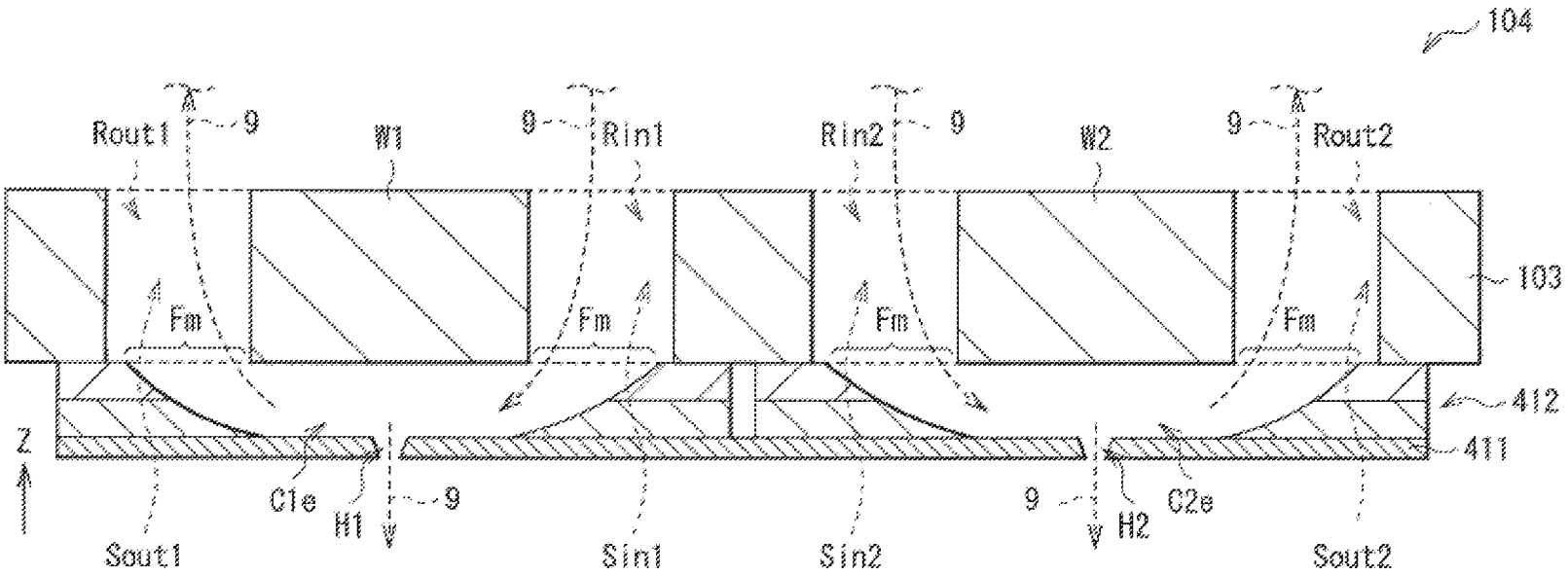
FIG. 6 is a schematic diagram showing a cross-sectional configuration example of a head chip related to a comparative example.

FIG. 6 is a diagram schematically showing a cross-sectional configuration example of a head chip (a head chip 104) according to a comparative example, and corresponds to a cross-sectional configuration example of the vicinity of the ejection channels C1*e*, C2*e*. As shown in FIG. 6, the head chip 104 of the comparative example corresponds to what is arranged not to provide the expanded flow channel sections Fe described above to the head chip 41 according to the present embodiment shown in FIG. 4. Specifically, in the head chip 104, the flow channel of the ink 9 in the part for communicating the supply slit Sin1, Sin2 and the discharge slit Sout1, Sout2 with the ejection channel C1*e*, C2*e* is constituted only by the principal flow channel section Fm. In other words, the cover plate 103 in the head chip 104 is not provided with both of the groove sections Din, Dout unlike the cover plate 413 in the head chip 41.

In such a head chip 104 according to the comparative example, since the cross-sectional area of the flow channel in the part for communicating the supply slit Sin1, Sin2 and the discharge slit Sout1, Sout2 with the ejection channel C1*e*, C2*e* is small (narrow), the following, for example, is brought about. That is, since it becomes difficult to ensure the flow rate of the ink 9, a shortage in supply quantity of the ink 9 to the ejection channel C1*e*, C2*e* occurs, and as a result, there is a possibility that the ejection failure such as a dead pixel or a white line occurs. Therefore, in the head chip 104 of this comparative example, there is a possibility that the reliability is damaged. It should be noted that if the size (the length of the straight part around the center) of the ejection channel C1*e*, C2*e* is increased in an attempt to increase the cross-sectional area of the flow channel in the communication part described above, the length in the Y-axis direction (the short-side direction) in the head chip 104 increases to incur growth in chip size as a result.

(Present Embodiment)

In contrast, in the head chip 41 according to the present embodiment, as shown in FIG. 4, the flow channel of the ink 9 in the part (the communication part) for communicating the supply slit Sin1, Sin2 and the discharge slit Sout1, Sout2 with the ejection channel C1*e*, C2*e* is provided with the expanded flow channel section Fe for increasing the cross-sectional area of the flow channel.

Thus, the following is achieved compared to the case (the case in which only the principal flow channel section Fm is provided) in which such an expanded flow channel section Fe is not provided as in the case of the head chip 104 of the comparative example described above. That is, since the cross-sectional area of the flow channel is increased in the flow channel in the communication part described above, it becomes easy to ensure the flow rate of the ink 9, and therefore, the ejection failure such as a dead pixel or a white line caused by the shortage in supply quantity of the ink 9 to the ejection channel C1*e*, C2*e* as described above is reduced. Therefore, it becomes possible to improve the ejection stability in the head chip 41, the inkjet head 4 and the printer 1 compared to the comparative example described above.

Further, since it is possible to increase the cross-sectional area of the flow channel in the communication part described above by providing such an expanded flow channel section Fe, it becomes unnecessary to increase the size (the length of the straight part around the center) of the ejection channel C1*e*, C2*e*, for example, as described above. Therefore, it becomes also possible to prevent (to achieve reduction of the chip size) the growth in chip size in the head chip 41.

Further, in particular in the present embodiment, as shown in FIG. 4, such an expanded flow channel section Fe is constituted by each of the groove sections Din, Dout respectively provided to the edge parts on the nozzle hole H1, H2 side of the inner side surfaces in the supply slit Sin1, Sin2 and the discharge slit Sout1, Sout2. Thus, the flow of the ink 9 becomes smooth when the ink 9 flows from the inside of the supply slit Sin1, Sin2 toward the nozzle hole H1, H2 via the ejection channel C1*e*, C2*e*. Therefore, in the present embodiment, it becomes possible to further improve the ejection stability in the head chip 41.

Further, in the present embodiment, as shown in FIG. 4, since the side surface of each of such groove sections Din, Dout has the inverse tapered shape described above, it becomes difficult for bubbles to be retained around the corner part in each of the groove sections Din, Dout (it becomes easy for the bubbles to flow), the flow of the ink 9 becomes smoother. Therefore, it becomes possible to further improve the ejection stability in the head chip 41. Incidentally, if the bubbles are retained in such a corner part, a turbulent flow occurs around the bubbles, and therefore, the flow of the ink 9 becomes complicated to exert a harmful influence on the ejection stability as a result.

In addition, in the present embodiment, as shown in FIG. 4, the expanded flow channel section Fe is disposed at least on the inflow side (the supply slit Sin1, Sin2 side) of the ink 9 to the inside of the ejection channel C1*e*, C2*e*. Thus, the following is achieved compared to the case (corresponding to Modified Example 3 described later) in which, for example, the expanded flow channel section Fe is disposed only on the outflow side (the discharge slit Sout1, Sout2 side) of the ink 9 from the inside of the ejection channel C1*e*, C2*e*. That is, since the expanded flow channel section Fe is disposed at least on the inflow side of the ink 9, a direct contribution to the ejection operation of the ink 9 is provided as a result, which results in an enhancement of the effect of reducing the ejection failure caused by the shortage in supply quantity of the ink 9 to the ejection channel C1*e*, C2*e*. Therefore, it becomes possible to achieve a further improvement of the ejection stability in the head chip 41.

Further, in particular in the present embodiment, as shown in FIG. 4, the expanded flow channel sections Fe (the groove sections Din, Dout) are disposed on both of the inflow side (the supply slit Sin1, Sin2 side) and the outflow side (the discharge slit Sout1, Sout2 side) of the ink 9 with respect to the ejection channel C1*e*, C2*e*. Thus, it becomes easy to ensure the circulation flow rate of the ink 9 between the head chip 41 and the outside (the ink tank 3). Therefore, it becomes possible to further improve the ejection stability in the head chip 41.

Further, in the present embodiment, as shown in FIG. 4, the side surfaces in the ejection channels C1*e*, C2*e* each have the arc-like shape described above. In the case in which the side surfaces of the ejection channels C1*e*, C2*e* each have the arc-like shape as described above, there is a tendency that the cross-sectional area of the flow channel of the ink 9 flowing between the supply slit Sin1, Sin2 and the discharge slit Sout1, Sout2, and the ejection channel C1*e*, C2*e* becomes particularly small. Therefore, it can be said that in this case, the effect of reducing the ejection failure caused by the shortage in supply quantity of the ink 9 to the ejection channel C1*e*, C2*e* described above becomes particularly significant.

2. Modified Examples

Then, some modified examples (Modified Examples 1 through 8) of the embodiment described above will be described. It should be noted that the same constituents as those in the embodiment are denoted by the same reference symbols, and the description thereof will arbitrarily be omitted.

Modified Example 1

Figure 7:
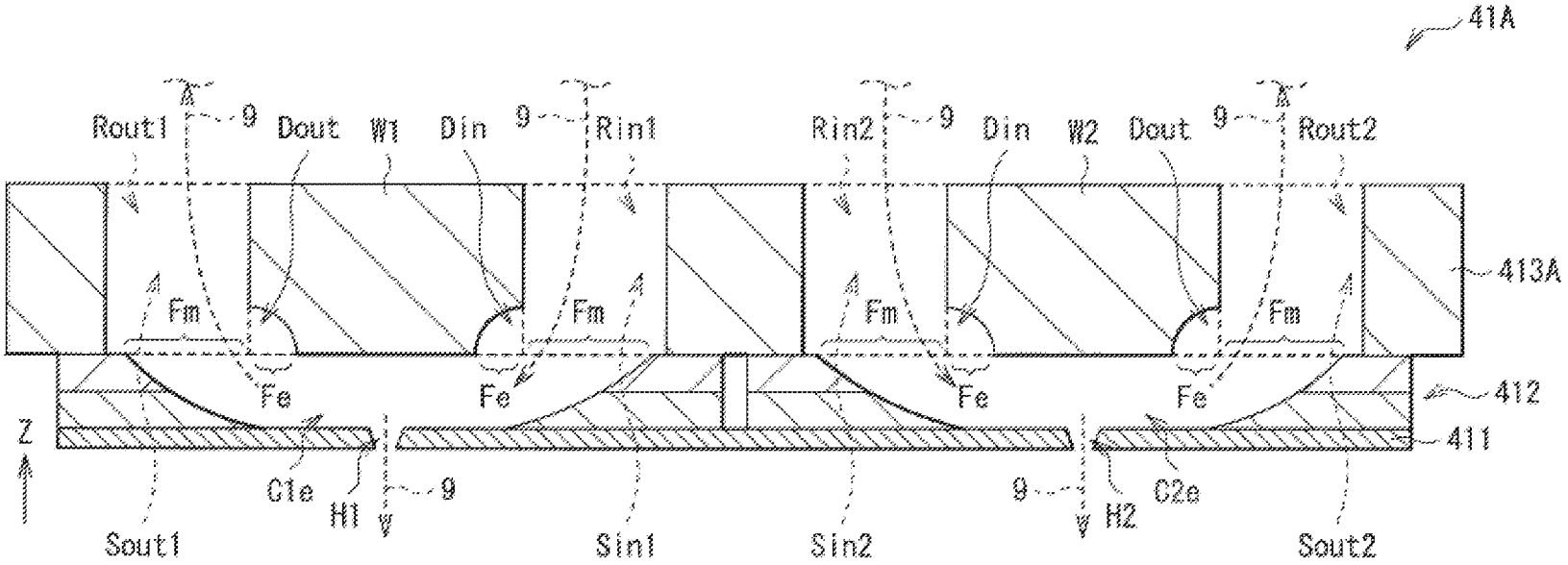
FIG. 7 is a schematic diagram showing a cross-sectional configuration example of a head chip related to Modified Example 1.

FIG. 7 is a diagram schematically showing a cross-sectional configuration example of a head chip (a head chip 41A) according to Modified Example 1, and corresponds to a cross-sectional configuration example of the vicinity of the ejection channels C1*e*, C2*e*. The head chip 41A (a cover plate 413A) of Modified Example 1 corresponds to what is obtained by changing the side surface shape of each of the groove sections Din, Dout each constituting the expanded flow channel section Fe in the head chip 41 (the cover plate 413) of the embodiment shown in FIG. 4, and the rest of the configuration is made basically the same.

Specifically, in the head chip 41 (FIG. 4) of the embodiment, the side surface of each of the groove sections Din, Dout has the inverse tapered shape. In contrast, in the head chip 41A (FIG. 7) of the present modified example, the side surface of each of the groove sections Din, Dout is shaped like a curved surface so that the cross-sectional area of the groove section Din, Dout gradually increases in a direction toward the ejection channel C1*e*, C2*e* (in a downward direction). It should be noted that the side surface shaped like a curved surface can be formed by, for example, sandblasting.

In the head chip 41A of the present modified example having such a configuration, it is also possible to obtain basically the same advantage due to the same function as that of the head chip 41 of the embodiment.

Specifically, in the present modified example, since the side surface of each of such groove sections Din, Dout is shaped like a curved surface, it becomes difficult for the bubbles to be retained around the corner part in each of the groove sections Din, Dout (it becomes easy for the bubbles to flow), the flow of the ink 9 becomes smoother. Therefore, it becomes possible to further improve the ejection stability in the head chip 41A.

Modified Examples 2, 3

Figure 8:
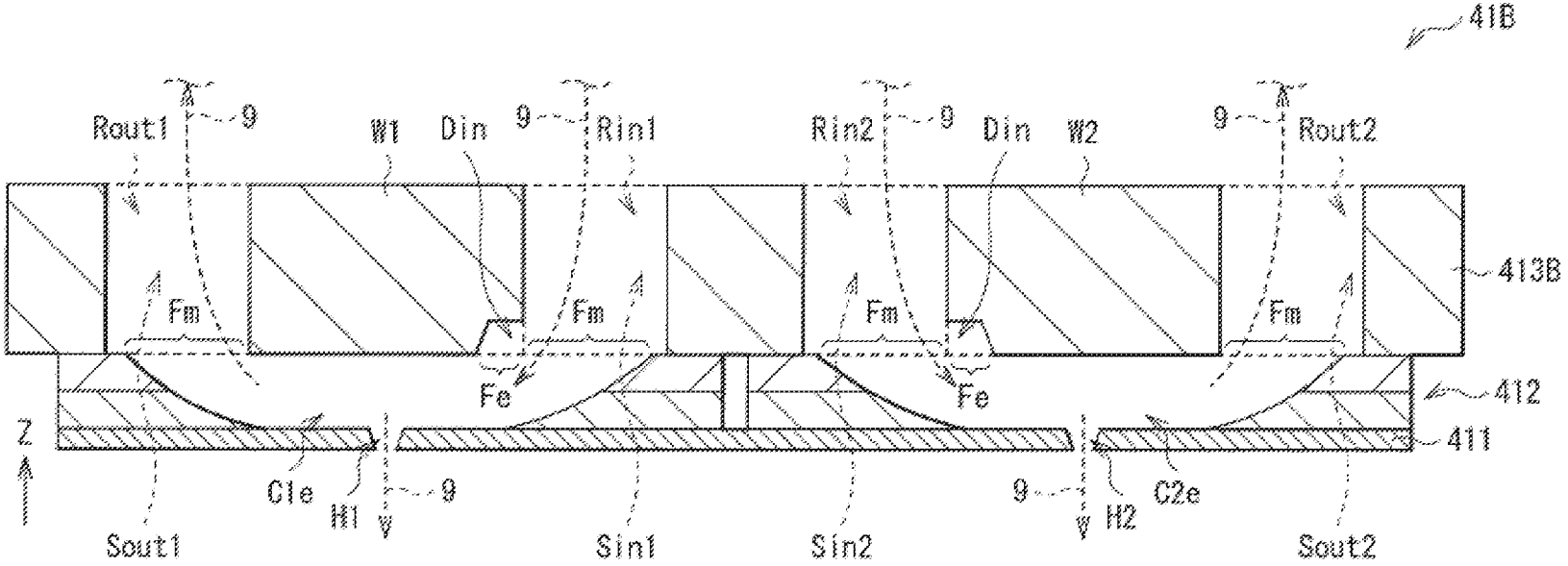
FIG. 8 is a schematic diagram showing a cross-sectional configuration example of a head chip related to Modified Example 2.

FIG. 8 is a diagram schematically showing a cross-sectional configuration example of a head chip (a head chip 41B) according to Modified Example 2, and corresponds to a cross-sectional configuration example of the vicinity of the ejection channels C1*e*, C2*e*. Further, FIG. 9 is a diagram schematically showing a cross-sectional configuration example of a head chip (a head chip 41C) according to Modified Example 3, and corresponds to a cross-sectional configuration example of the vicinity of the ejection channels C1*e*, C2*e*.

In the head chip 41B (a cover plate 413B) of Modified Example 2 shown in FIG. 8, unlike the head chip 41 (the cover plate 413) of the embodiment shown in FIG. 4, there is adopted the following configuration. That is, in the head chip 41B, the expanded flow channel section Fe (the groove section Din) is disposed only on the inflow side (the supply slit Sin1, Sin2 side) of the ink 9 to the inside of the ejection channel C1*e*, C2*e*.

Figure 9:
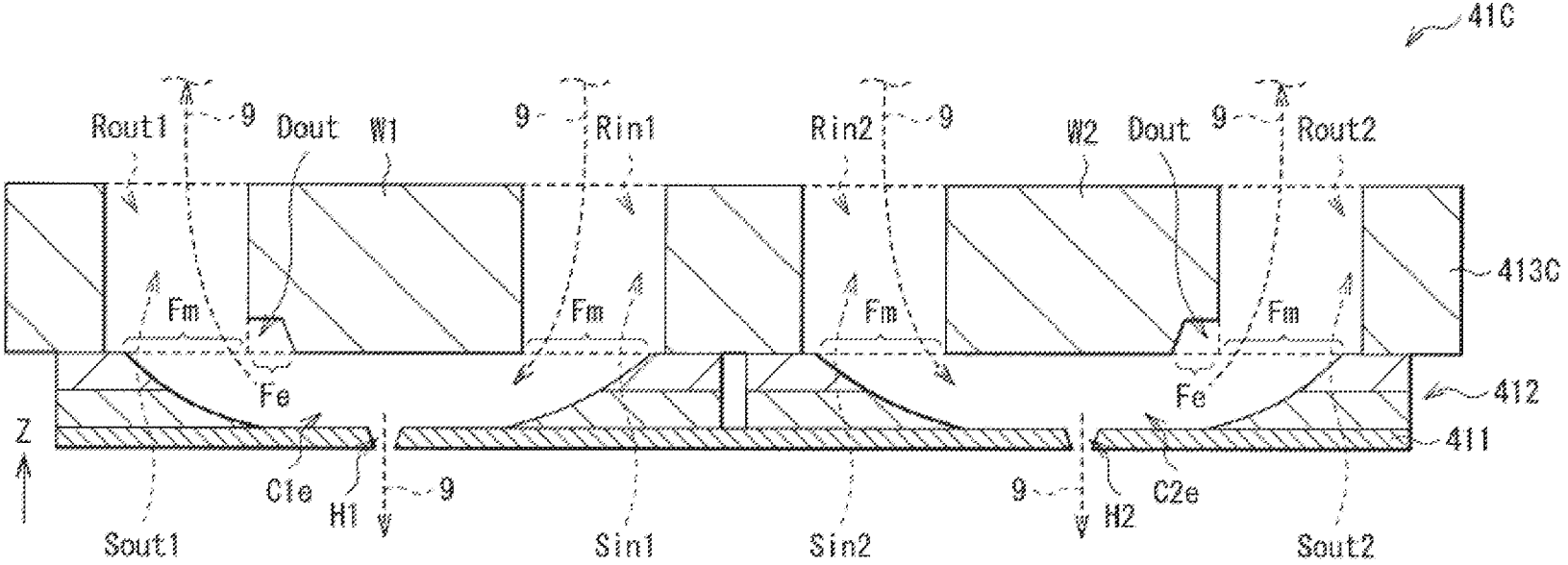
FIG. 9 is a schematic diagram showing a cross-sectional configuration example of a head chip related to Modified Example 3.

In contrast, in the head chip 41C (a cover plate 413C) of Modified Example 3 shown in FIG. 9, unlike the head chip 41 (the cover plate 413) of the embodiment shown in FIG. 4, there is adopted the following configuration. That is, in the head chip 41C, the expanded flow channel section Fe (the groove section Dout) is disposed only on the outflow side (the discharge slit Sout1, Sout2 side) of the ink 9 from the inside of the ejection channel C1*e*, C2*e*.

In the head chips 41B, 41C of Modified Examples 2, 3 having such configurations, it is also possible to obtain basically the same advantage due to the same function as that of the head chip 41 of the embodiment.

It should be noted that since in the head chip 41 of the embodiment, the expanded flow channels Fe (the groove sections Din, Dout) are disposed on both of the inflow side and the outflow side of the ink 9 with respect to the ejection channel C1*e*, C2*e*, the following is brought about in the head chips 41B, 41C of Modified Examples 2, 3. That is, compared to the embodiment, in Modified Examples 2, 3, the effect of reducing the ejection failure described above decreases, and in particular in Modified Example 3, the direct contribution to the ejection operation of the ink 9 cannot be provided, and therefore, the effect of the reduction further decreases. Therefore, it can be said that it is desirable to dispose the expanded flow channel sections Fe (the groove sections Din, Dout) on both of the inflow side and the outflow side of the ink 9 as in the embodiment.

Modified Example 4

Figure 10:
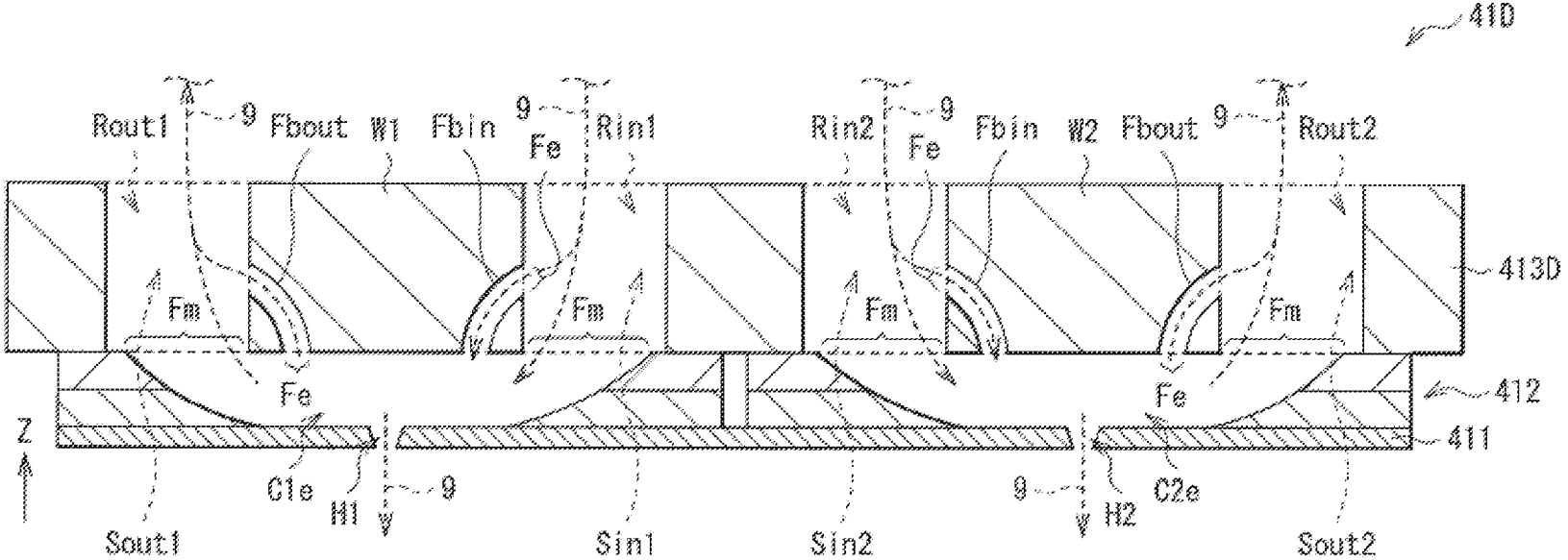
FIG. 10 is a schematic diagram showing a cross-sectional configuration example of a head chip related to Modified Example 4.

FIG. 10 is a diagram schematically showing a cross-sectional configuration example of a head chip (a head chip 41D) according to Modified Example 4, and corresponds to a cross-sectional configuration example of the vicinity of the ejection channels C1*e*, C2*e*. The head chip 41D (a cover plate 413D) of Modified Example 4 corresponds to what is obtained by changing the structure of the expanded flow channel section Fe in the head chip 41 (the cover plate 413) of the embodiment shown in FIG. 4, and the rest of the configuration is made basically the same.

Specifically, in the head chip 41 (FIG. 4) of the embodiment, the expanded flow channel section Fe is constituted by each of the groove sections Din, Dout described above. In contrast, in the head chip 41D (FIG. 10) of the present modified example, the expanded flow channel section Fe is constituted by each of bypass flow channels Fbin, Fbout described hereinafter.

As shown in FIG. 10, the bypass flow channel Fbin is a flow channel extending from the inner side surface of the supply slit Sin1, Sin2 to reach the ejection channel C1*e*, C2*e* while penetrating the wall part W1, W2. Specifically, in the head chip 41D, there are provided the bypass flow channel Fbin extending from the inner side surface of the supply slit Sin1 to reach the ejection channel C1*e* while penetrating the wall part W1, and the bypass flow channel Fbin extending from the inner side surface of the supply slit Sin2 to reach the ejection channel C2*e* while penetrating the wall part W2.

Further, as shown in FIG. 10, the bypass flow channel Fbout is a flow channel extending from the inner side surface of the discharge slit Sout1, Sout2 to reach the ejection channel C1*e*, C2*e* while penetrating the wall part W1, W2. Specifically, in the head chip 41D, there are provided the bypass flow channel Fbout extending from the inner side surface of the discharge slit Sout1 to reach the ejection channel C1*e* while penetrating the wall part W1, and the bypass flow channel Fbout extending from the inner side surface of the discharge slit Sout2 to reach the ejection channel C2*e* while penetrating the wall part W2.

As described above, in the head chip 41D of the present modified example, the expanded flow channel section Fe is constituted by each of the bypass flow channels Fbin, Fbout described above. In other words, in the head chip 41D, the flow channel of the ink 9 in the part for communicating the supply slit Sin1, Sin2 and the discharge slit Sout1, Sout2 with the ejection channel C1*e*, C2*e* is constituted by a plurality of flow channel sections (the principal flow channel section Fm and each of the bypass flow channels Fbin, Fbout) independent of each other. Thus, the risk that a foreign matter such as dust gets stuck in the flow channel in the communication part is reduced, and at the same time, it becomes possible to flexibly design the layout, the position, the shape and so on of the entire flow channel in the communication part. Therefore, in addition to the fact that it becomes possible to reduce the ejection failure caused by the shortage in supply quantity of the ink 9 to thereby improve the ejection stability in the head chip 41D as described above, it becomes possible to enhance the reliability of the head chip 41D, and at the same time, it becomes also possible to enhance the convenience.

Further, in the present embodiment, as shown in FIG. 10, the expanded flow channel section Fe is disposed at least on the inflow side (the supply slit Sin1, Sin2 side) of the ink 9 to the inside of the ejection channel C1*e*, C2*e*. Thus, the following is achieved compared to the case (corresponding to Modified Example 6 described later) in which, for example, the expanded flow channel section Fe is disposed only on the outflow side (the discharge slit Sout1, Sout2 side) of the ink 9 from the inside of the ejection channel C1*e*, C2*e*. That is, since the expanded flow channel section Fe is disposed at least on the inflow side of the ink 9, a direct contribution to the ejection operation of the ink 9 is provided as a result, which results in an enhancement of the effect of reducing the ejection failure caused by the shortage in supply quantity of the ink 9 to the ejection channel C1*e*, C2*e*. Therefore, it becomes possible to achieve a further improvement of the ejection stability in the head chip 41D.

Further, in particular in the present modified example, as shown in FIG. 10, the expanded flow channel sections Fe (the bypass flow channels Fbin, Fbout) are disposed on both of the inflow side (the supply slit Sin1, Sin2 side) and the outflow side (the discharge slit Sout1, Sout2 side) of the ink 9 with respect to the ejection channel C1*e*, C2*e*. Thus, it becomes easy to ensure the circulation flow rate of the ink 9 between the head chip 41D and the outside (the ink tank 3). Therefore, it becomes possible to further improve the ejection stability in the head chip 41D.

Modified Examples 5, 6

Figure 11:
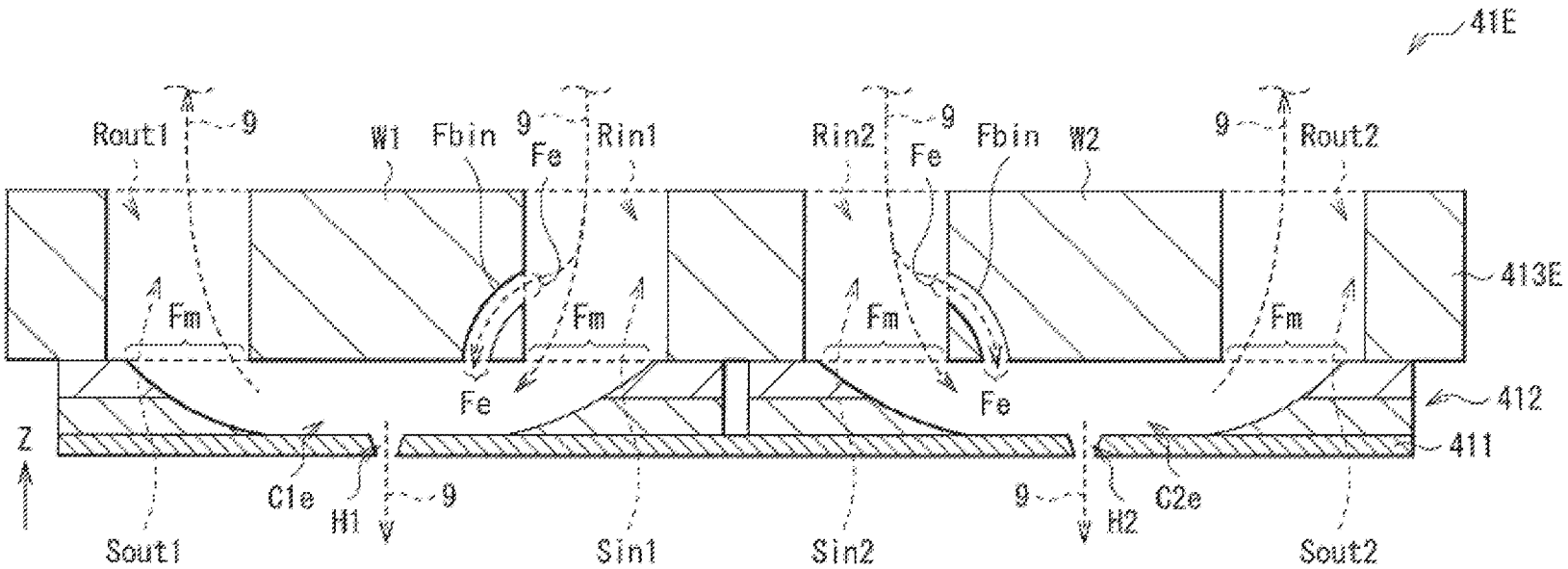
FIG. 11 is a schematic diagram showing a cross-sectional configuration example of a head chip related to Modified Example 5.

FIG. 11 is a diagram schematically showing a cross-sectional configuration example of a head chip (a head chip 41E) according to Modified Example 5, and corresponds to a cross-sectional configuration example of the vicinity of the ejection channels C1*e*, C2*e*. Further, FIG. 12 is a diagram schematically showing a cross-sectional configuration example of a head chip (a head chip 41F) according to Modified Example 6, and corresponds to a cross-sectional configuration example of the vicinity of the ejection channels C1*e*, C2*e*.

In the head chip 41E (a cover plate 413E) of Modified Example 5 shown in FIG. 11, unlike the head chip 41D (the cover plate 413D) of the Modified Example 4 shown in FIG. 10, there is adopted the following configuration. That is, in the head chip 41E, the expanded flow channel section Fe (the bypass flow channel Fbin) is disposed only on the inflow side (the supply slit Sin1, Sin2 side) of the ink 9 to the inside of the ejection channel C1*e*, C2*e*.

Figure 12:
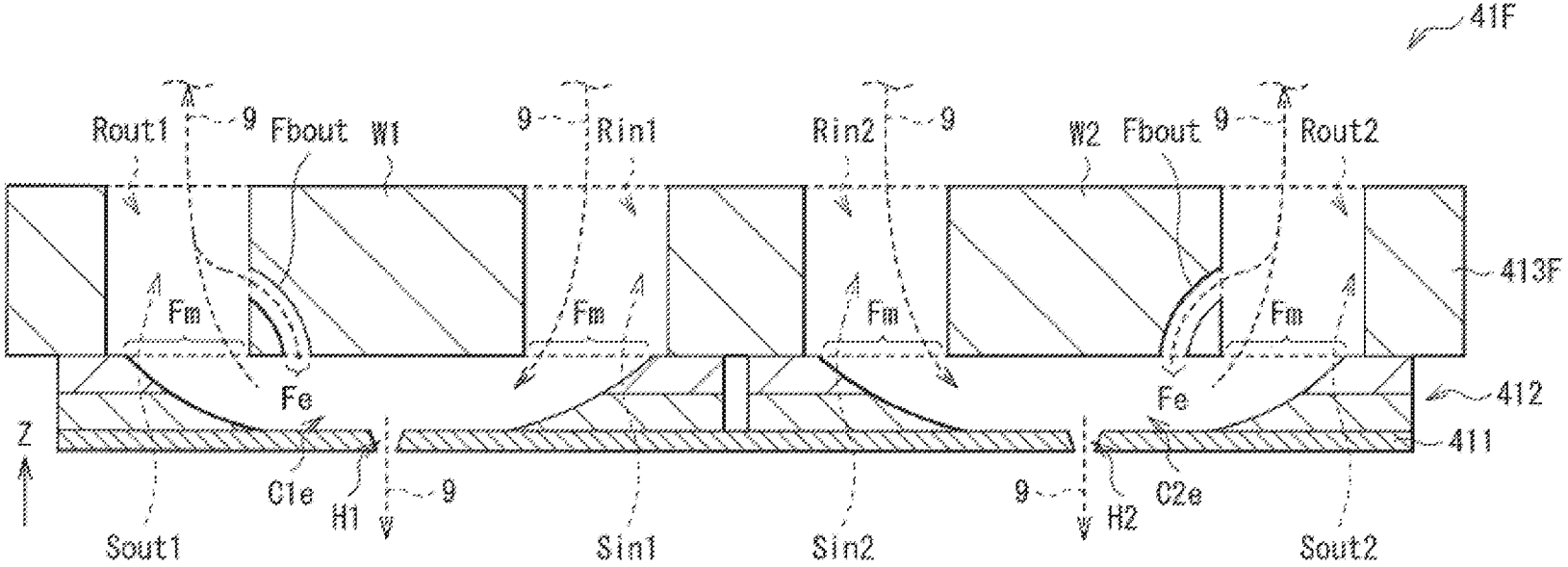
FIG. 12 is a schematic diagram showing a cross-sectional configuration example of a head chip related to Modified Example 6.

In contrast, in the head chip 41F (a cover plate 413F) of Modified Example 6 shown in FIG. 12, unlike the head chip 41D (the cover plate 413D) of the Modified Example 4 shown in FIG. 10, there is adopted the following configuration. That is, in the head chip 41F, the expanded flow channel section Fe (the bypass flow channel Fbout) is disposed only on the outflow side (the discharge slit Sout1, Sout2 side) of the ink 9 from the inside of the ejection channel C1*e*, C2*e*.

In the head chips 41E, 41F of Modified Examples 5, 6 having such configurations, it is also possible to obtain basically the same advantage due to the same function as that of the head chip 41D of Modified Example 4.

It should be noted that since in the head chip 41D of Modified Example 4, the expanded flow channels Fe (the bypass flow channels Fbin, Fbout) are disposed on both of the inflow side and the outflow side of the ink 9 with respect to the ejection channel C1*e*, C2*e*, the following is brought about in the head chips 41E, 41F of Modified Examples 5, 6. That is, compared to Modified Example 4, in Modified Examples 5, 6, the effect of reducing the ejection failure described above decreases, and in particular in Modified Example 6, the direct contribution to the ejection operation of the ink 9 cannot be provided, and therefore, the effect of the reduction further decreases. Therefore, it can be said that it is desirable to dispose the expanded flow channel sections Fe (the bypass flow channels Fbin, Fbout) on both of the inflow side and the outflow side of the ink 9 as in Modified Example 4.

Modified Examples 7, 8

Figure 13:
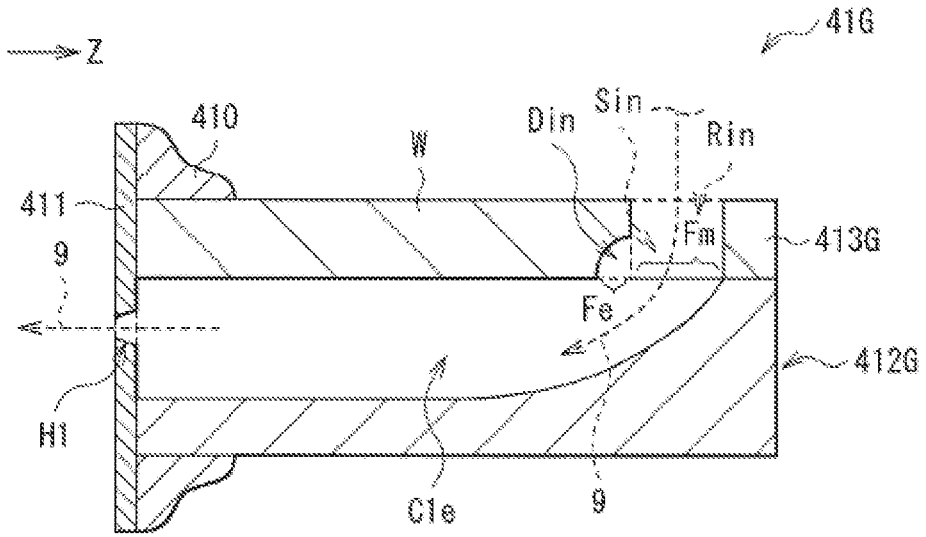
FIG. 13 is a schematic diagram showing a cross-sectional configuration example of a head chip related to Modified Example 7.
Figure 14:
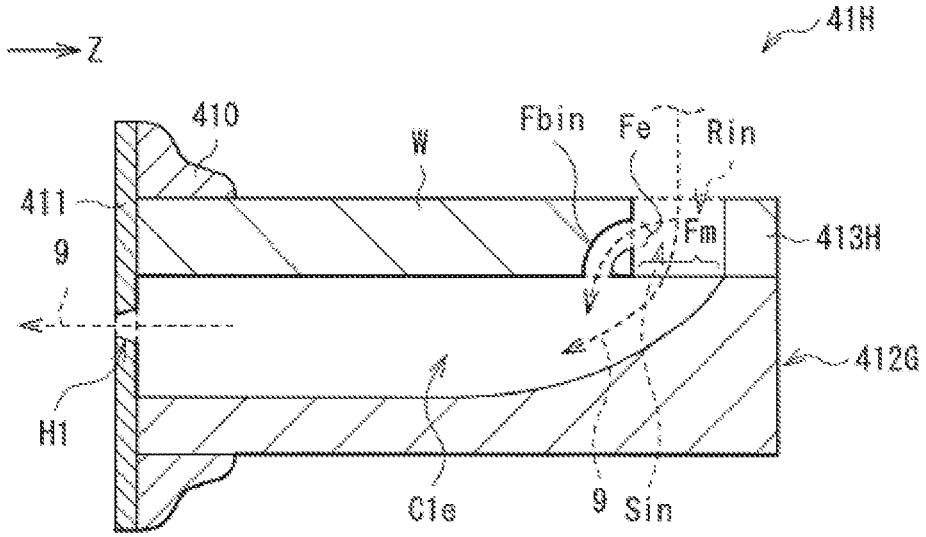
FIG. 14 is a schematic diagram showing a cross-sectional configuration example of a head chip related to Modified Example 8.

FIG. 13 is a diagram schematically showing a cross-sectional configuration example of a head chip (a head chip 41G) according to Modified Example 7, and corresponds to a cross-sectional configuration example of the vicinity of the ejection channels C1*e*. Further, FIG. 14 is a diagram schematically showing a cross-sectional configuration example of a head chip (a head chip 41H) according to Modified Example 8, and corresponds to a cross-sectional configuration example of the vicinity of the ejection channels C1*e*.

In the head chips 41G, 41H of Modified Examples 7, 8 shown in FIG. 13 and FIG. 14, unlike the head chips 41, 41A through 41F of the embodiment and Modified Examples 1 through 6 having already been described hereinabove, there is adopted the following configuration. That is, the head chips 41, 41A through 41F of the embodiment and Modified Examples 1 through 6 are each a head chip to be applied to a so-called side-shoot type inkjet head for ejecting the ink 9 from a central part in the extending direction (the oblique direction described above) of the channel C1, C2. In contrast, the head chips 41G, 41H of Modified Examples 7, 8 are each arranged to be a head chip to be applied to a so-called edge-shoot type inkjet head for ejecting the ink 9 along the extending direction (the Z-axis direction) of the channel C1 such as the ejection channel C1*e* as described hereinafter. It should be noted that as shown in FIG. 13 and FIG. 14, in the edge-shoot type inkjet head, an actuator plate 412G is provided with a configuration (a configuration formed of a single piezoelectric substrate) of the cantilever type described above.

Specifically, in the head chip 41G of Modified Example 7 shown in FIG. 13, there are provided the actuator plate 412G having a plurality of ejection channels C1*e* and a plurality of dummy channels C1*d*, and a cover plate 413G for covering above the actuator plate 412G. It should be noted that the channels C1 (the ejection channels C1*e* and the dummy channels C1*d*) in the actuator plate 412G extend along the Z-axis direction as described above. Further, the head chip 41G is provided with a nozzle plate 411 having a plurality of nozzle holes H1 individually communicated with the plurality of ejection channels C1*e*, and extending in the X-Y plane, and a support plate 410 for supporting the actuator plate 412G and the cover plate 413G, and the nozzle plate 411. It should be noted that the cover plate 413G is provided with a supply slit Sin for making the ink 9 inflow into the ejection channel C1*e*, and a wall section W for covering above the ejection channel C1*e*.

Further, in the head chip 41G, in the flow channel of the ink 9 in a part (the communication part) for communicating the supply slit Sin with the ejection channel C1*e*, there is disposed the expanded flow channel section Fe which is provided to the wall part W of the cover plate 413G, and increases the cross-sectional area of the flow channel. In particular, in the head chip 41G, such an expanded flow channel section Fe is constituted by a groove section Din provided to an edge part on the nozzle hole H1 side of the inner side surfaces in the supply slit Sin.

In contrast, the head chip 41H of Modified Example 8 shown in FIG. 14 is arranged to be what is obtained by providing a cover plate 413H instead of the cover plate 413G in the head chip 41G of Modified Example 7 described above. In the head chip 41H, similarly to the head chip 41G, in the flow channel of the ink 9 in the part (the communication part) for communicating the supply slit Sin with the ejection channel C1*e*, there is disposed the expanded flow channel section Fe which is provided to the wall part W of the cover plate 413H, and increases the cross-sectional area of the flow channel.

It should be noted that in the head chip 41H, such an expanded flow channel section Fe is constituted by the bypass flow channel Fbin extending from the inner side surface of the supply slit Sin to reach the ejection channel C1*e* while penetrating the wall part W.

In the head chips 41G, 41H of Modified Examples 7, 8 having such configurations (the edge-shoot type), it is also possible to obtain basically the same advantage due to the same function as that of the head chip 41, 41A through 41F (the side-shoot type) having already been described.

3. Other Modified Examples

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head and the head chip, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment described above, the description is presented citing the inkjet head 4 of the two column type (having the two nozzle columns An1, An2), but the example is not a limitation. Specifically, for example, it is also possible to adopt an inkjet head of a single column type (having a single nozzle column), or an inkjet head of a multi-column type (having three or more nozzle columns) with three or more columns (e.g., three columns or four columns).

Further, for example, in the embodiment described above and so on, there is described the case in which the ejection channels (the ejection grooves) and the dummy channels (the non-ejection grooves) each extend along the oblique direction in the actuator plate 412, but this example is not a limitation. Specifically, it is also possible to arrange that, for example, the ejection channels and the dummy channels extend along the Y-axis direction in the actuator plate 412.

Further, for example, the cross-sectional shape of each of the nozzle holes H1, H2 is not limited to the circular shape as described in the above embodiment and so on, but can also be, for example, an elliptical shape, a polygonal shape such as a triangular shape, or a star shape.

In addition, regarding the configuration example of the expanded flow channel section Fe, for example, those explained in the embodiment and so on described above (the configuration example such as the groove sections Din, Dout or the bypass flow channels Fbin, Fbout) are not limitations, and other configuration examples can also be adopted.

Further, in the embodiment described above, the description is presented citing the circulation type inkjet head for using the ink 9 while circulating the ink 9 mainly between the ink tank and the inkjet head as an example, but the example is not a limitation. Specifically, it is also possible to apply the present disclosure to a non-circulation type inkjet head using the ink 9 without circulating the ink 9.

Further, the series of processes described in the above embodiment and so on can be arranged to be performed by hardware (a circuit), or can also be arranged to be performed by software (a program). In the case of arranging that the series of processes is performed by the software, the software is constituted by a program group for making the computer perform the functions. The programs can be incorporated in advance in the computer described above, and are then used, or can also be installed in the computer described above from a network or a recording medium and are then used.

In addition, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "head chip" and the "liquid jet head" (the inkjet heads) of the present disclosure are applied to other devices than the inkjet printer. Specifically, for example, it is also possible to arrange that the "head chip" and the "liquid jet head" of the present disclosure are applied to a device such as a facsimile or an on-demand printer.

In addition, it is also possible to apply the variety of examples described hereinabove in arbitrary combination.

It should be noted that the advantages described in the specification are illustrative only but are not a limitation, and another advantage can also be provided.

The present disclosure may be embodied as described below.

<1>

A head chip adapted to jet liquid comprising an actuator plate having a plurality of ejection grooves each filled with the liquid; a nozzle plate having a plurality of nozzle holes individually communicated with the plurality of ejection grooves; and a cover plate having a through hole through which the liquid flows into and/or from the ejection groove, and a wall part adapted to cover the ejection groove, wherein a flow channel of the liquid in a part adapted to communicate the through hole and the ejection groove with each other includes a principal flow channel section, and an expanded flow channel section provided to the wall part, and adapted to increase a cross-sectional area of the flow channel.

<2>

The head chip according to <1>, wherein the expanded flow channel section is a groove section provided to an edge part on the nozzle hole side of an inner side surface of the through hole.

<3>

The head chip according to <2>, wherein a side surface of the groove section has one of an inverse tapered shape and a shape of a curved surface so that a cross-sectional area of the groove section gradually increases in a direction toward the ejection groove.

<4>

The head chip according to <1>, wherein the expanded flow channel section is a bypass flow channel extending from an inner side surface of the through hole to reach the ejection groove while penetrating the wall part.

<5>

The head chip according to any one of <1> to <4>, wherein the liquid circulates between an inside of the head chip and an outside of the head chip the through hole includes a first through hole adapted to make the liquid inflow into the ejection groove, and a second through hole adapted to make the liquid outflow from the ejection groove, and the expanded flow channel section is provided to the flow channel at, at least, a part adapted to communicate the first through hole and the ejection groove with each other in the first through hole and the second through hole.

<6>

The head chip according to <5>, wherein the expanded flow channel section is provided to both of the flow channel in a part adapted to communicate the first through hole and the ejection groove with each other, and the flow channel in a part adapted to communicate the second through hole and the ejection groove with each other.

<7>

The head chip according to any one of <1> to <6>, wherein the ejection groove has a side surface having an arc-like shape so that a cross-sectional area of the ejection groove gradually decreases in a direction from the cover pate side toward the nozzle plate side.

<8>

A liquid jet head comprising the head chip according to any one of <1> to <7>.

<9>

A liquid jet recording device comprising the liquid jet head according to <8>; and a containing section adapted to contain the liquid.

What is claimed is:

1. A head chip adapted to jet liquid comprising:

an actuator plate having a plurality of ejection grooves each filled with the liquid;

a nozzle plate having a plurality of nozzle holes individually communicated with the plurality of ejection grooves; and a cover plate having a through hole through which the liquid flows into and/or from the ejection groove, and a wall part adapted to cover the ejection groove, wherein a flow channel of the liquid in a part adapted to communicate the through hole and the ejection groove with each other includes a principal flow channel section, and an expanded flow channel section provided to the wall part, and adapted to increase a cross-sectional area of the flow channel.

2. The head chip according to claim 1, wherein the expanded flow channel section is a groove section provided to an edge part on the nozzle hole side of an inner side surface of the through hole.

3. The head chip according to claim 2, wherein a side surface of the groove section has one of an inverse tapered shape and a shape of a curved surface so that a cross-sectional area of the groove section gradually increases in a direction toward the ejection groove.

4. The head chip according to claim 1, wherein the expanded flow channel section is a bypass flow channel extending from an inner side surface of the through hole to reach the ejection groove while penetrating the wall part.

5. The head chip according to claim 1, wherein the liquid circulates between an inside of the head chip and an outside of the head chip the through hole includes a first through hole adapted to make the liquid inflow into the ejection groove, and a second through hole adapted to make the liquid outflow from the ejection groove, and the expanded flow channel section is provided to the flow channel at, at least, a part adapted to communicate the first through hole and the ejection groove with each other in the first through hole and the second through hole.

6. The head chip according to claim 5, wherein the expanded flow channel section is provided to both of the flow channel in a part adapted to communicate the first through hole and the ejection groove with each other, and the flow channel in a part adapted to communicate the second through hole and the ejection groove with each other.

7. The head chip according to claim 1, wherein the ejection groove has a side surface having an arc-like shape so that a cross-sectional area of the ejection groove gradually decreases in a direction from the cover pate side toward the nozzle plate side.

8. A liquid jet head comprising:

the head chip according to claim 1.

9. A liquid jet recording device comprising:

the liquid jet head according to claim 8; and a containing section adapted to contain the liquid.

* * * * *